US006220672B1

(12) United States Patent
Weihrauch

(10) Patent No.: US 6,220,672 B1
(45) Date of Patent: Apr. 24, 2001

(54) METHOD FOR THE PRODUCTION OF BRISTLE GOODS

(75) Inventor: Georg Weihrauch, Wald-Michelbach (DE)

(73) Assignee: Coronet-Werke GmbH, Wald-Michelbach (DE)

( * ) Notice: Subject to any disclaimer, the term of this patent is extended or adjusted under 35 U.S.C. 154(b) by 0 days.

(21) Appl. No.: 09/171,003

(22) PCT Filed: Apr. 17, 1997

(86) PCT No.: PCT/EP97/01933

§ 371 Date: Oct. 9, 1998

§ 102(e) Date: Oct. 9, 1998

(87) PCT Pub. No.: WO97/39649

PCT Pub. Date: Oct. 30, 1997

(30) Foreign Application Priority Data

Apr. 23, 1996 (DE) ..... 196 16 112

(51) Int. Cl.[7] ..... A46B 3/02

(52) U.S. Cl. ..... 300/21; 15/167.1; 15/192

(58) Field of Search ..... 300/21, 4, 5, 8, 300/9; 156/72; 264/243, 301, 261; 15/207.2, 192, 167.1

(56) References Cited

U.S. PATENT DOCUMENTS 2,078,358 * 4/1937 Wright et al. .
5,176,427 * 1/1993 Weihrauch .
5,622,411 * 4/1997 Weihrauch .

FOREIGN PATENT DOCUMENTS 40 271 08 3/1992 (DE) .
0 142 885 5/1985 (EP) .
0 346 646 12/1989 (EP) .
0 472 857 4/1992 (EP) .

* cited by examiner

*Primary Examiner*—Deborah Jones
*Assistant Examiner*—Jennifer McNeil
(74) *Attorney, Agent, or Firm*—Paul Vincent

(57) ABSTRACT

Brushes with a bristle carrier and a bristle facing of individual, vertical plastic bristles are manufactured in that the individual bristles with their fastening-side ends at the front are introduced into in each case one hole of a hole template, whose hole diameter is slightly larger than that of a single bristle and whose hole pattern corresponds to the positioning of the bristles within the bristle facing or part thereof, to such an extent that their fastening-side ends project roughly to the same extent at the opposite side of the hole template, the bristles are subsequently fixed against axial and radial displacement in the hole template, at least on the fastening-side surface of the bristle carrier is prepared a bed of liquid, curable material, the liquid material flows round the bristles with their fastening-side ends immersed in the bed and subsequently the bed is cured.

13 Claims, 5 Drawing Sheets

METHOD FOR THE PRODUCTION OF BRISTLE GOODS

BACKGROUND OF THE INVENTION

The invention relates to a method for the manufacture of brushes with a bristle carrier and a bristle facing formed from individual, vertical plastic bristles.

In the present context brushes include all types of floor cleaning implements with a bristle facing, as well as belts, plates, mats, etc. which are faced with bristles. They can in particular be body care or hygienic brushes, such as toothbrushes, massaging brushes, hair brushes, etc., or brushes for applying coating agents, cosmetics, medicaments, etc., or floor mats, brushing belts, polishing belts, etc.

Conventionally with such brushes the bristles are combined into bundles or larger packets and in this form are fixed to the bristle carrier. Previously bundles were fixed mechanically in that a bristle tuft was looped and fixed by means of an anchoring means in the bristle carrier. This fixing procedure is complicated and in some applications, particularly for sanitary brushes, leads to unwelcome secondary phenomena, because the holes which are necessary in the bristle carrier lead to a deposition of dirt and bacteria. In the case of larger diameter bundles or bristle packets, such as are e.g. required in paint brushes, the bundles or packets are fixed in a cement or adhesive bed. With the arrival of plastic bristles other fastening possibilities became available, namely the welding or heat-sealing of the bundles to the carrier or the moulding of the bundle ends into the molten carrier material.

All methods in which the bristle bundles or packets are embedded in a more or less liquid mass and are fixed by the curing thereof, suffer from the decisive disadvantage that the bristles are only inadequately anchored. Thus, after the curing of the mass, the bundles or packets must be combed out to remove loose bristles. Even during use individual bristles, which have an inadequate extraction resistance are released. In certain applications, particularly with paint brushes, coating brushes, etc., this has displeasing consequences, because the separated or released bristles drop into the medium being applied and are difficult to eliminate therefrom without leaving behind traces. In toothbrushes this can have extremely unwelcome consequences, because such detached bristles frequently jam in the interdental space and are difficult to remove.

To the extent that bristle carriers and bristles, as is nowadays usually the case, are made from plastics and joined together by welding, they must be made from the same plastic or material pairs such that they can be integrally welded together to the extent that an adequate joining strength is obtained. This requirement is only fulfilled by a few material pairs and in particular not by those having very different characteristics. However, this is frequently the case with brushes. Thus, the bristle carrier, which normally also forms the brush handle, must generally be rigid and made from an inexpensive plastic, whereas the bristles are made from a high-grade plastic with a comparatively high resistance to wear, good bending capacity and high resistance to alternate flexing. Thus, for bristle carriers use is mainly made of polyolefins, whereas polyamides are used for the bristles. These and other suitable plastic pairs cannot or cannot easily be welded. Much the same applies with respect to the moulding in of the bristles, because here mainly surface adhesive forces must ensure the necessary resistance to extraction, whereas an integral connection only occurs to a limited extent. Therefore the bundles must be melted at their ends to thickened portions in order to produce an additional frictional connection in the carrier.

In addition, brushes are known, in which the bristle facing has, apart from bristle bundles, individual vertical bristles or are made entirely from such individual bristles. Thus, EP 165 546 A1 describes a toothbrush, whose facing partly comprises bristle bundles and partly individual bristles. The individual bristles are arranged in surface-covering manner and, like the bundles, are fixed by welding to the plastic bristle carrier. As has already been intimated, this presupposes specific material pairs and generally required for the carrier the use of a much too expensive plastic so as to adapt to the bristles. Moreover, the bristles obtain their stability and bending capacity and more particularly also their permanent flexing, in that the extruded monofilaments are stretched or drawn and subsequently generally also thermally stabilized, in order to obtain a molecular longitudinal orientation, which is lost as soon as the bristles are exposed to an elevated temperature. Thus, during welding, the fastening-side ends of the bristles are damaged. The bristles lose their bending elasticity and consequently their recovery capacity. The same applies on injecting the bristle bundles into the molten plastic mass of the bristle body and also here the same plastics are recommended for the carrier and the bristles (DE 895 140, 900 809).

In another known toothbrush according to U.S. Pat. No. 4,592,594 the individual bristles are combined into a packet forming the entire bristle facing and are inserted in a frame-like carrier. The bristles are welded together along their circumferential contact faces. Apart from the possible damage to the bristles, in this variant the extraction resistance of the bristles is inadequate, because the contact face with a circular bristle cross-section is substantially only linear and therefore the bristles are only interconnected along four such linear contact faces.

In the case of paint brushes, it is also known (DE 1 050 304 A, U.S. Pat. No. 2,664,316) to melt the entire bristle packet at the fastening-side end and shape same to a plate-like thickening, which serves to maintain the bristle packet in the carrier. It is also known (DE 812 304 B), to mould the bristle packet into the liquid plastic mass of the carrier. More particularly in the case of the first-mentioned construction there occurs the already described damage at the bristle base. However, in the case of paint brushes these methods are particularly unsuitable for use reasons, because the bristles are closely packed and the brush has an inadequate storage space for receiving the application media. Such storage spaces are normally obtained in the case of paint brushes through the use of inserts and the like (DE 92 06 072 U1, DE 30 25 010 A1). These are inserts disposed within the fastening zone and laterally displace the bristles in this area to create chamber-like free spaces immediately adjacent to insert. These free spaces absorb the application medium and release it when pressure is applied to the brush and the bristles bend. These chambers are an essential prerequisite for a uniform application and also for the fact that an adequately large surface can be covered with a single brush stroke. This is particularly important with plastic bristles, because compared with natural bristles they have an inferior retentivity for the application medium. It must also be borne in mind that in all brushes with which media are to be transferred to a surface, the application media have widely differing viscosities. This even applies with toothbrushes with which both paste-like and gel-like dentifrices have to be received and distributed. Consequently, from the use standpoint, brushes only give optimum results in the case of application media having a specific viscosity range, but only operate inadequately with other application media. Therefore, particularly in the case of paint brushes, a large range must be kept in stock in order to create the necessary production prerequisites.

Numerous attempts have been made to fasten bristles in a solitary arrangement to the bristle carrier. Apart from the aforementioned welding, which is unsuitable for material reasons (EP 165 546), it is known (DE 44 10 236) to form bristle monofilaments into loops and in the vicinity of the latter to prefix the monofilaments in rows by warp and weft threads and subsequently to mould with plastic material in the vicinity of the fastening. This method is extremely complicated and costly and always leads to a relatively open structure of the bristle facing. It is also known in connection with larger diameter special bristles (EP 292 693), to weld the bristles to the carrier or to once again loop the bristles and mechanically fix them by means of an anchoring means in the bristle carrier. The disadvantages of both fastening methods have already been explained. It is finally known (GB 2 035 076 A), to inject the bristles in the form of pins and fasten the bristles to the carrier, or to produce the bristles together with the carrier in an injection mould (U.S. Pat. No. 3,583,019, CH 661 851 A5). Here it is not a question of bristles in the normal sense of the term, but of pin-like structures with a relatively large diameter, which necessarily have a completely inadequate retentivity for the application media and which are therefore only suitable for e.g. hairbrushes and the like.

The problems mentioned above are solved by the invention by proposing a method with which the brushes can be manufactured with individual, vertical plastic bristles, in which the bristles have clearly defined and predeterminable spacings, accompanied by the adaptation to the particular coating or application medium and the intended use for the brush.

SUMMARY OF THE INVENTION

According to the invention this problem is solved in that the individual bristles with their fastening-side ends at the front are introduced into in each case one hole of a hole template, whose hole diameter is slightly larger than that of a single bristle and whose hole pattern corresponds to the positioning of the bristles within the bristle facing or part thereof, to such an extent that their fastening-side ends project roughly to the same extent at the opposite side of the hole template, the bristles are subsequently fixed against axial and radial displacement in the hole template, at least on the fastening-side surface of the bristle carrier is prepared a bed of liquid, curable material, the liquid material flows round the bristles with their fastening-side ends immersed in the bed and subsequently the bed is cured.

In the method according to the invention the bristles are individually supplied to the production process in a mutual arrangement such as corresponds to their subsequent positioning in the bristle facing. This is achieved with the hole template, whose holes are arranged congruently with the position of the individual bristles within the facing and consequently position the bristles prior to fastening. In this prepositioning the bristles are fixed, so that they cannot be either radially or axially displaced therefrom. Simultaneously or beforehand, at least at the fastening-side surface of the bristle carrier a bed of a liquid, curable material is prepared. The fastening-side ends of the bristles projecting over the hole template and immersed in the bed are individually and completely flowed round by the liquid bed material and firmly bound in following the curing of the bed.

Thus, the individual bristles can be connected to the bristle carrier with a clearly defined mutual spacing and in a predetermined arrangement. It is possible to implement any desired spacing of the bristles within the bristle facing, as well as any desired association of the bristles with one another by means of corresponding hole templates. This ensures that the bristles are not closely packed together and instead clearly defined capillaries are formed. Any random capillary shape can be obtained by the association of the bristles and any random capillary cross-section by the spacing of the bristles. This allows an optimum adaptation to the intended use of brushes manufactured in this way and in particular the aforementioned geometry can be adapted to the viscosity of the coating medium to be processed. For low viscosity coating media, the spacing will be made closer than for higher viscosity media.

As a result of the clearly defined bristle spacing, it is more particularly ensured that the bed flows entirely around the fastening-side end of each individual bristle and embedding thereof occurs in the curing bed material. Each bristle is perfectly anchored and all the bristles of the facing have the same extraction resistance. There is no longer any need for a combing out of the bristle facing and individual bristles can no longer be separated. From the use standpoint, the clearly defined spacing also ensures a perfect cleaning of the bristle facing by flushing. This is particularly important with sanitary brushes, toothbrushes and paint brushes. In addition, after use the bristle facing can rapidly dry to prevent the embedding of bacteria. The use characteristics of each bristle are better utilized than with an arrangement in bundles or packets, where the inner bristles are supported by the outer bristles, so that their bending capacity cannot be utilized. The outer bristles are more strongly stressed, so that they are also more rapidly deformed or otherwise rendered unusable, whereas with a bristle facing of individual, vertical, spaced bristles, each bristle can evolve its action and all the bristles are stressed in substantially the same way, so that the service life can be increased, because there is no premature failure of individual bristles.

Preferably the bristles are immersed in the liquid material bed by means of the hole template. Instead of this, it is naturally possible to move the bed against the fixed hole template.

In a preferred development, the immersion depth of the fastening-side ends of the bristles is predetermined in that the hole template with the fixed bristles is displaced on an adjustable path. This makes it possible to predetermine the desired or necessary embedding length of the bristles and consequently their extraction resistance in a precise, reproducible manner.

The individual bristles can be supplied in continuous monofilament form to the hole template and can be drawn into the latter. After fixing the continuous monofilaments in the hole template, the bristles can be cut to the desired length from the continuous monofilaments at the hole template supply side. The cutting to length can naturally also take place after the curing of the bed.

The continuous monofilaments can be kept in stock individually or in a plurality on a reel and can be drawn therefrom. If several monofilaments are stored on a reel, they are individualized prior to the supply to the hole template. Alternatively the bristles can be processed from longer monofilament portions or cut to length.

Thus, the invention offers the possibility of processing without difficulty bristles made from different materials, having different diameters and/or cross-sections (circular, polygonal, etc.), as well as with different surface structures (smooth, roughened, flocked, etc.). In particular, it is very difficult to process structured or polygonal bristles in bundle form or uncontrolled capillary spaces are formed in the bundles. Here again, clearly defined conditions are created by the invention.

The invention also offers the possibility of producing bristeless free spaces within the bristle facing in that the bristles are only inserted in those holes of the hole template, which are congruent with the bristle positions in the bristle facing.

In this way, within the bristle facing can be obtained capillaries with a larger cross-section or even chamber-like free spaces, in order to create storage spaces with a random cross-section. It is also possible with a single hole template to produce a bristle facing with different bristle spacings, provided that they are located in the spacing grid in the hole pattern of the template.

Instead of this, the hole template can also be closed in the areas where the bristle facing has larger gaps.

The invention also offers the possibility of producing a bristle facing of individual, vertical bristles and bristles arranged in bundles, in that the individual bristles and the bristles combined in bundles are simultaneously introduced into a hole template, whose hole pattern corresponds to the positioning of the individual bristles and the bristle bundles within the bristle facing, to such an extent that the fastening-side ends of the individual bristles and the bundles project on the opposite side of the hole template. The individual bristles and the bundles are then simultaneously immersed in the bed and otherwise the procedure is as hereinbefore. In this way it is possible to obtain brushes with clearly differently acting brushing faces.

The bed on the bristle carrier can be formed by a liquid adhesive, a plastic polymerizing cold or at moderate temperature, or the melted bristle carrier itself or its melted surface. As a function of the bristle and bed material pair, a non-positive and/or integral union is obtained.

The extraction resistance of the individual bristles can be increased in that the individual bristles following insertion into the hole template are surface-structured or thermally or mechanically shaped on their projecting, fastening-side ends and subsequently immersed in the bed, so that a type of positive engagement is also obtained.

In another variant of the method, following the insertion of the bristles into the hole template or the fixing thereof in an upstream, similar hole template and the cutting flat thereof at the ends facing the fastening-side ends and then said ends are worked, e.g. rounded to a shape diverging from the planar sectional face thereof. Only then are the fastening-side ends of the bristles immersed in the bed by means of the hole template.

As a result of the precisely spaced arrangement the working of the use-side ends of the bristles can take place in an optimum manner, namely mechanically, e.g. by grinding, chemical treatment or thermal treatment, e.g. using laser beams. Particularly in the latter method the special advantages of the spaced arrangement of the individual bristles becomes apparent. The laser machining of the bristle ends for rounding purposes is admittedly known. However, the method fails with bristles in bundle form, because the bristle ends have different spacings within the bundle and can consequently not be precisely controlled, so that part of the bristles are welded together. As a result of the carefully spaced, reproducible arrangement of the bristle ends in the method according to the invention, the control of the bristle ends with the laser source is accurately possible.

In a further variant of the method, following the working of the ends the bristles are released from the fixture and by different, axial displacement are moved with their worked ends into a curved envelope diverging from the sectional plane, are then cut flat at their fastening-side ends and are then immersed in the bed.

In this method variant it is possible to arrange the use-side ends of the bristles within the bristle facing in a random topography. In the case of paint brushes this offers the advantage that a brush facing with a conically tapering shape can be obtained. Similar advantages arise with toothbrushes, in that conical profiles can be produced, so that the longest bristles can effectively engage in the interdental spaces, whereas the shorter bristles clean the tooth surface.

The invention is described in greater detail hereinafter relative to the drawings, wherein show:

DESCRIPTION OF THE PREFERRED EMBODIMENT

Figure 1:
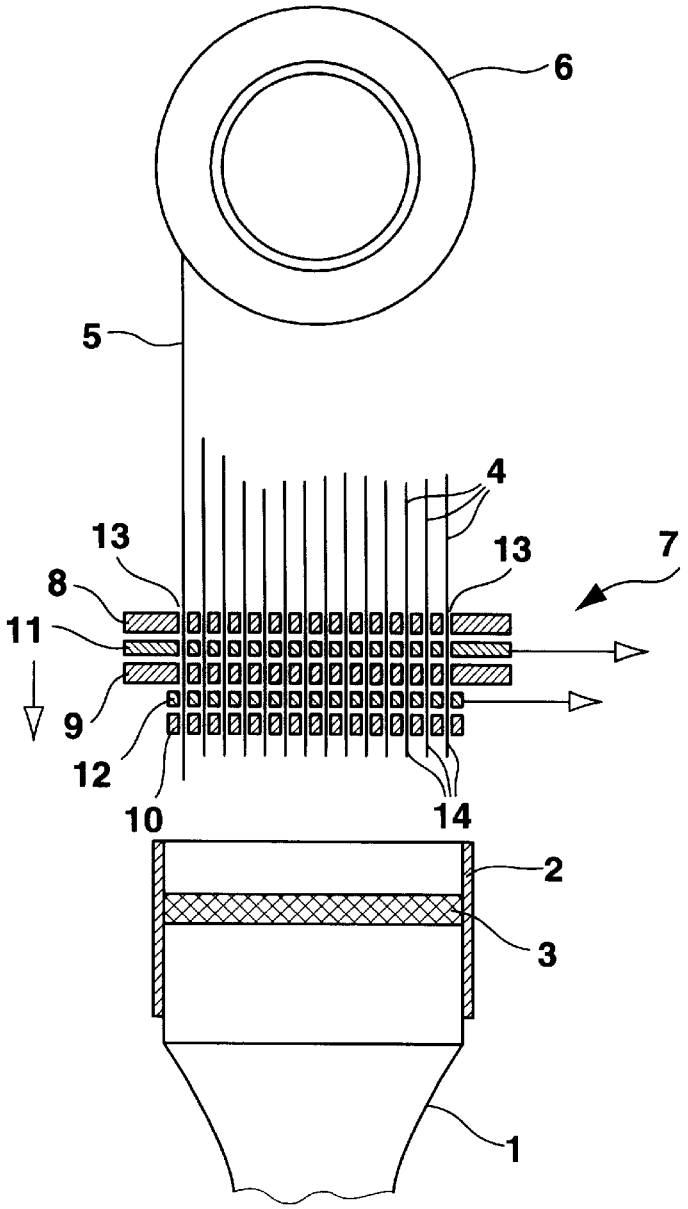
FIG. 1 A diagrammatic view of a plant for performing the method in a first method stage.

The manufacture of a paint brush will be described relative to the embodiment of FIGS. 1 and 2. The brush has a handle 1, which is provided on its head with a so-called brush ferrule 2, which forms a type of sleeve and defines the outer contour of the brush bristle facing. Within the brush ferrule 2 is formed a bed 3 of a liquid or liquefiable material. The handle 1, ferrule 2 and bed 3 together form the bristle carrier. In not shown manner, the brush handle 1 is positioned in the production installation.

Figure 1A:
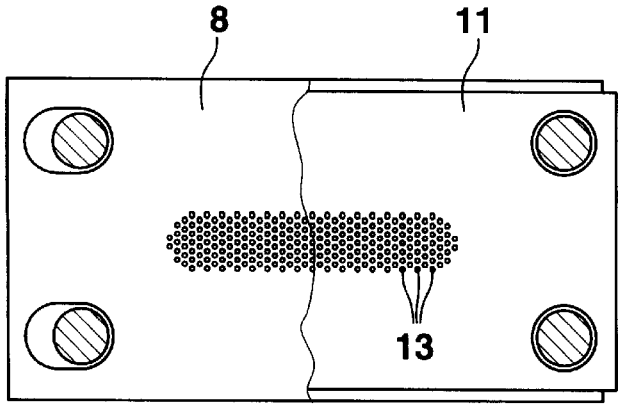
FIG. 1*a* A plan view of an embodiment of the hole template.

The bristles 4 are to be fastened in individual, standing manner to the bristle carrier. In the embodiment shown in FIGS. 1 and 2 the bristles are supplied as continuous monofilaments 5 from a reel 6. The leading end of the continuous monofilaments 5 is inserted and drawn in to a hole template 7. For this purpose the hole template is in multipart form. It comprises three congruent template parts 8, 9 and 10 and intermediately positioned clamping plates 11, 12, which are movable in accordance with the horizontal directional arrows. In all its parts the hole template 7 has holes 13, whose diameter is slightly larger than the cross-section of the individual bristles 4. The hole template 7 also has a hole pattern, which is congruent with the positioning and arrangement of the individual bristles 4 within the bristle facing of the paint brush. This can be seen in FIG. 1*a,* where the template part 8 is shown in broken away form and it is also possible to see the clamping plate 11 below it.

The leading end of the continuous monofilaments 4 is drawn or shoved into the hole template 7 until the leading ends project over said template 7 at the opposite side. They then form the fastening-side ends 14 of the individual bristles 4. In this position the clamping plates 11 and 12 are moved into the clamping position (to the right in the drawing), so that the bristles are axially and radially fixed. The hole template 9 with the fixed bristles is then moved towards the bristle carrier until the fastening-side ends 14 are immersed in the liquid bed 3. Simultaneously the front template part and one of the clamping plates are immersed in the brush ferrule 2, so that the latter has a centering action, whilst the template part 9 rests on the free face of the ferrule 2 and consequently predetermines the immersion depth of the fastening-side ends 14 in the bed 3.

Subsequently the bristles 4 are cut to length from the continuous monofilaments 5 on the back or top of the hole template 7 by a transverse knife.

Figure 2:
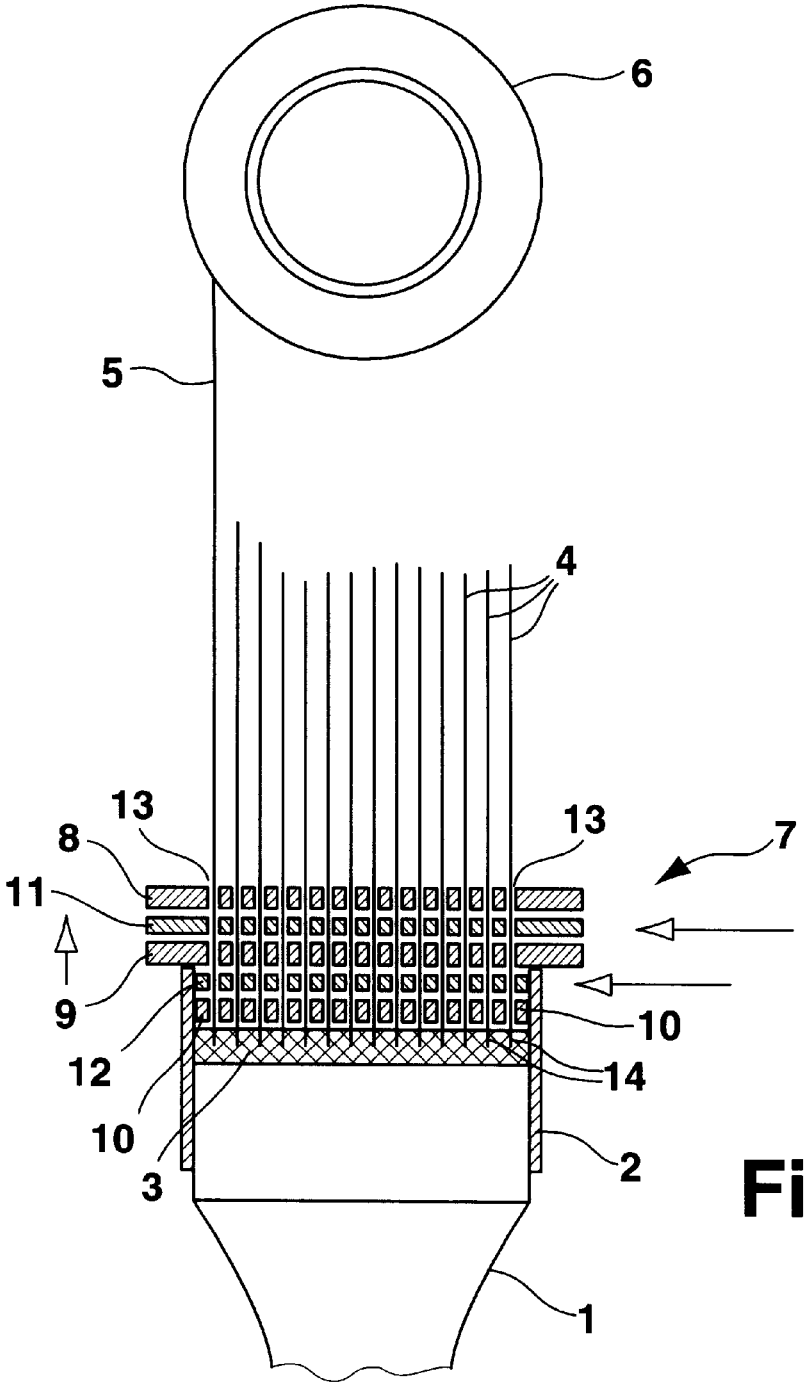
FIG. 2 The plant according to FIG. 1 in a further method stage.

The hole template 7 can naturally be filled with the bristles at some other location and transported with the completely prepared bristle facing into the position according to FIG. 2. In place of the hole template, it is also possible to move the bristle carrier against the fixed template.

Following prehardening or curing of the bed 3, the hole template is moved back, so that the finished brush is removed according to FIG. 2 and the next bristle carrier is brought into the production position and the monofilaments 5 are once again drawn out by a bristle length.

Figure 2A:
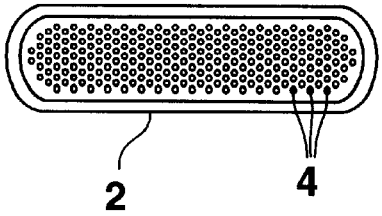
FIG. 2*a* A plan view of the finished brush.

As shown in the lower representation of FIGS. 2 and 2*a*, the individual bristles 4 have a clearly defined mutual spacing, which is reproduced on a larger scale to facilitate understanding in the upper part of the representation. It is clear that when all the holes 13 of the hole template 7 within the bristle facing are not filled larger gaps can be produced, which can serve as a storage space for a coating medium.

Figure 3A:
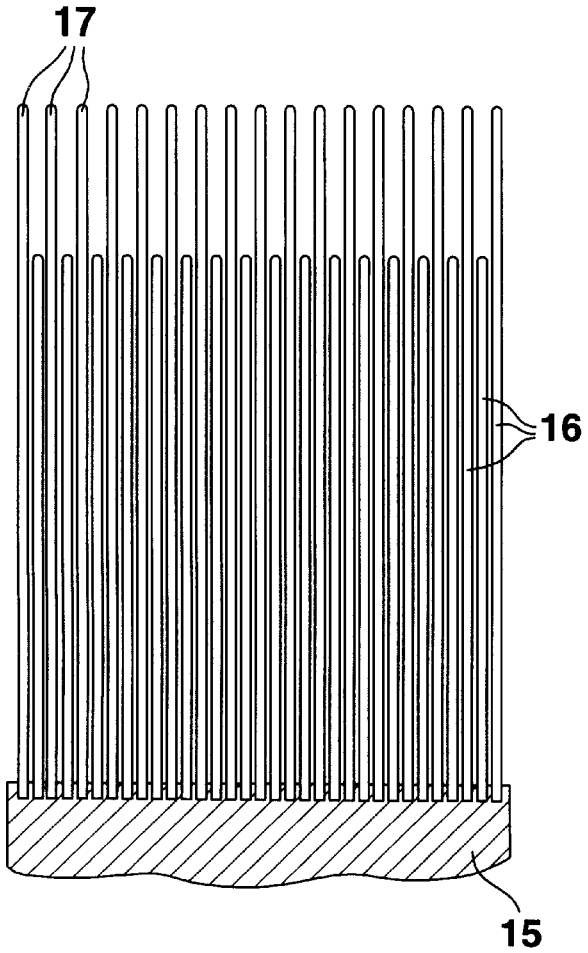
FIG. 3*a* A longitudinal section of a paint brush embodiment.
Figure 3C:
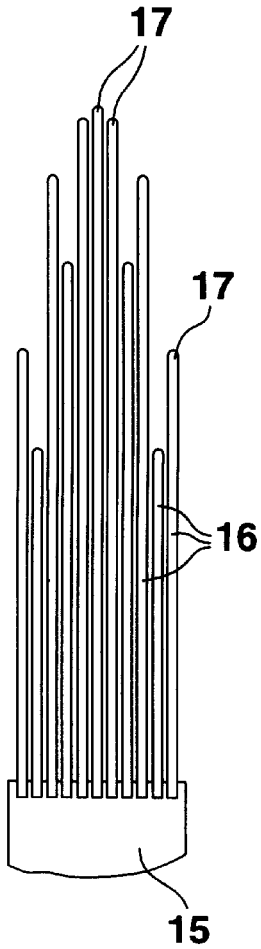
FIG. 3*c* A side view of the embodiment of FIGS. 3*a* and 3*b*.
Figure 3B:
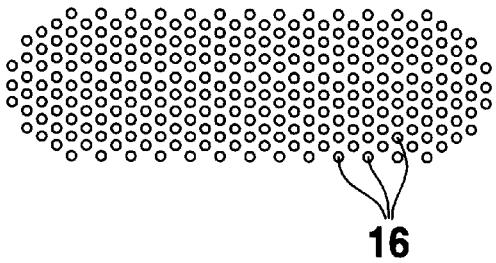
FIG. 3*b* A cross section of the embodiment of FIG. 3*a*
Figure 4A:
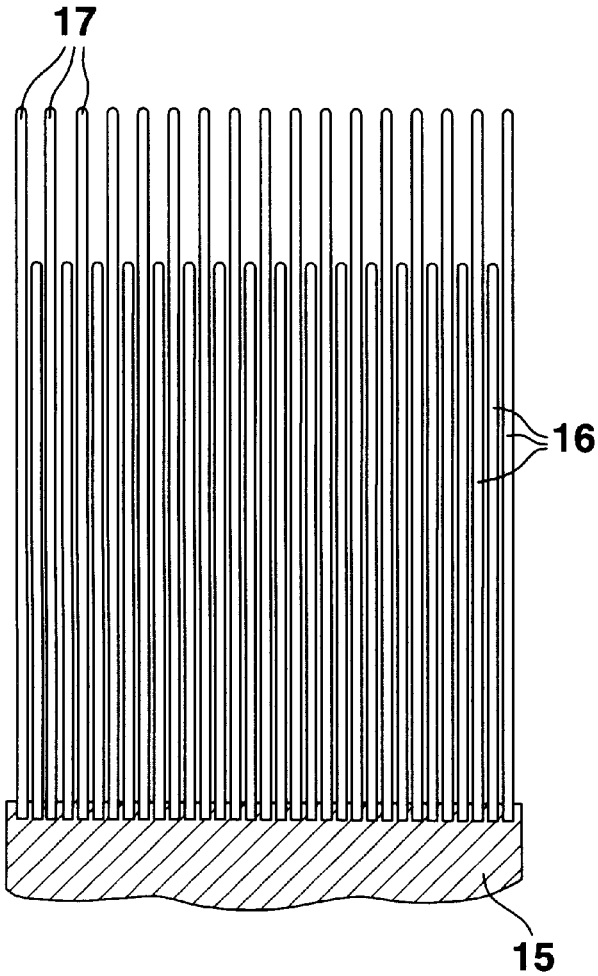
FIG. 4*a* A further embodiment of a paint brush in longitudinal section.

FIG. 3 shows an embodiment of a paint brush. In FIG. 4*a* the bristle carrier 15 is shown, which has at its fastening-side surface the curing bedding material. The individual bristles 16 are equidistantly arranged and embedded, but have, as shown in FIG. 3*c*, different lengths, so that the bristles also have a different bending behaviour towards their free end and between the shorter and longer bristle ends storage spaces are created, as can in particular be seen in FIG. 1*c*. Thus, the bristle ends are in a curved envelope.

Manufacture takes place in such a way that the bristles fixed in the hole template 7 are firstly cut flat at their ends opposite to the fastening-side ends 14 and subsequently working of said ends takes place, so that they e.g. acquire spherically curved, rounded tips or points 17. The bristles are then axially displaced to a varying degree in accordance with the desired topography following the release of the clamping plates 11, 12. The bristles projecting with unequal length at the opposite side are subsequently cut flat. The ends of the individual bristles 16 projecting over the hole template 7 are then immersed and fixed in the bed 3 (FIG. 1).

Figure 4C:
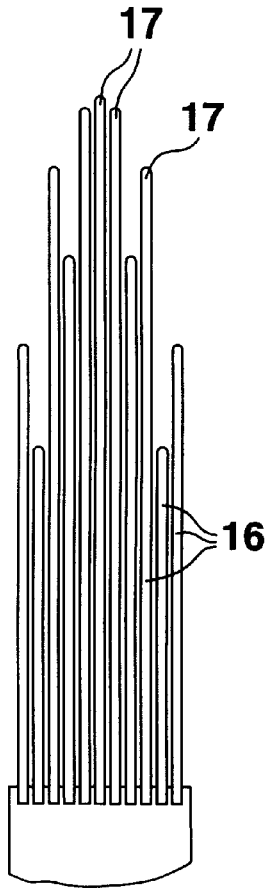
FIG. 4*c* A side view of the embodiment of FIGS. 4*a* and 4*b*.
Figure 4B:
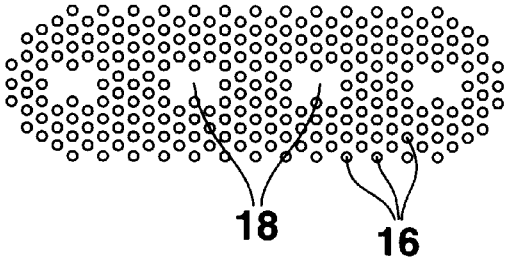
FIG. 4*b* A cross section of the embodiment of FIG. 4*a*.

FIG. 4 shows a modified embodiment, in which in the median longitudinal plane of the bristle facing individual holes of the hole template are not filled or the hole template is closed there, so that within the bristle facing chamber-like free spaces 18 are formed, which can serve as a storage space for the coating medium.

Figure 5A:
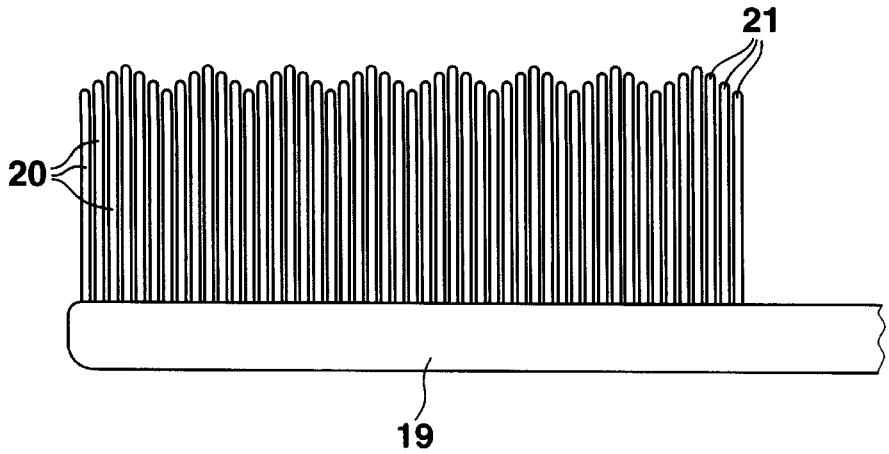
FIG. 5*a* A side view of a toothbrush embodiment.
Figure 5B:
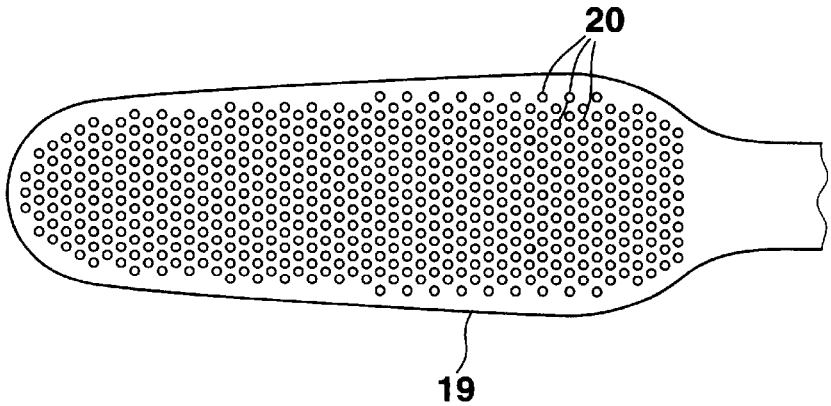
FIG. 5*b* A plan view of the embodiment of FIG. 5*a*.

FIG. 5 shows a toothbrush with a brush head 19 forming the bristle carrier. The entire bristle facing is formed from individual, vertical or standing bristles 20, which are fixed to the brush head 19 with the same mutual spacing and so as to largely fill the surface of said head. The ends 21 of the individual bristles 20 are once again rounded in dome-like manner. In addition, the bristle ends 21 are located on an envelope with a type of wave profile and in the horizontal or transverse direction (perpendicular to the drawing plane) continuous wave troughs and tops are formed.

Figure 6:
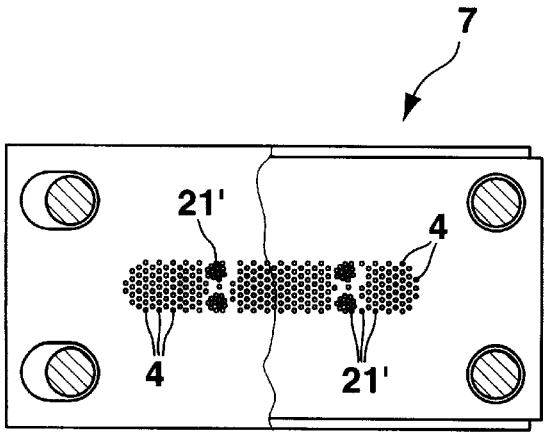
FIG. 6 A plan view of another embodiment of the hole template with inserted bristles.

It is readily apparent that the method according to the invention allows the manufacture of random bristle arrangements within a bristle facing and therefore allows an adaptation of a brush to the particular use in an optimum manner. FIG. 6 only shows in exemplified manner a hole template 7 making it possible, apart from individual, standing bristles 4, which are guided and fixed in corresponding holes, to also guide bundles 21' with closely juxtaposed bristles into corresponding, larger holes.

What is claimed is:

1. A method for the manufacture of brushes with a bristle carrier and a bristle facing of individual, vertical plastic bristles, the method comprising the steps of:

a) introducing each individual bristle at fastening sided ends thereof through respective holes of a template, said holes having a hole diameter slightly larger than a bristle diameter, said template having a hole pattern corresponding to positioning of the bristles within the bristle facing, the bristles projecting, in spaced apart relationship corresponding to a hole pattern of said template, through and past an exit side of said template by a substantially same amount;

b) fixing each individual bristle with respect to axial and radial displacement within said template;

c) submerging, following step b), each individual bristle projecting past said exit side of said template into a bed of liquid curable material to immerse said fastening sided ends of the bristles in said liquid bed such that said liquid flows around ends of the bristles; and d) curing said liquid bed.

2. The method of claim 1, wherein step c) comprises the step of holding said bristles using said template during submersion.

3. The method of claim 2, wherein an immersion depth of the bristles in said liquid is defined by moving said template along an adjustable path.

4. The method of claim 1, further comprising the steps of supplying the bristles to said template as continuous monofilaments by drawing said monofilaments into said template and cutting said monofilaments into bristles of a desired length at an input side of said template following step b).

5. The method of claim 4, wherein the bristles are cut following step d).

6. The method of claim 1, further comprising the step of generating gaps within the bristle facing by only inserting bristles into template holes congruent with bristle positions in the bristle facing.

7. The method of claim 1 further comprising the step of combining individual bristles into bundles prior to step a), wherein step a) comprises the step of simultaneously introducing individual bristles and said bristle bundles into said template holes, said template having a hole pattern corresponding to a positioning of individual bristles and bristle bundles within the bristle facing, wherein said bundles and said individual bristles project beyond said exit side of said template, and wherein step c) comprises the step of simultaneous submerging said bundles and said individual bristles into said liquid bed.

8. The method of claim 1, further comprising the step of at least one of surface structuring and thermally or mechanically shaping ends of said individual bristles after step a) and prior to step c).

9. The method of claim 1, further comprising, between steps b) and c), the steps of cutting bristle ends to a planar surface at a side opposite to said fastening sided ends and subsequently working said planar surface of bristle ends into a new planar contour.

10. The method of claim 9, wherein the subsequently working step comprises the step of releasing the fixed bristles to move the bristle through differing axial displacements into a curved envelope and further comprising the step of subsequently cutting said fastening sided ends prior to step c).

11. A method for the manufacture of brushes with a bristle carrier and a bristle facing of individual, vertical plastic bristles, the method comprising the steps of:

a) introducing each individual bristle at fastening sided ends thereof through respective holes of a template, said holes having a hole diameter slightly larger than a bristle diameter, said template having a hole pattern corresponding to positioning of the bristles within the bristle facing, the bristles projecting, in spaced apart relationship corresponding to a hole pattern of said template, through and past an exit side of said template by a substantially same amount;

b) fixing each individual bristle with respect to axial and radial displacement within said template;

c) submerging, following step b), each individual bristle projecting past said exit side of said template into a bed of liquid curable material to immerse said fastening sided ends of the bristles in said liquid bed such that said liquid flows around ends of the bristles, said liquid curable material comprising one of a liquid adhesive, a plastic polymerizing cold, and a plastic polymerizing at a moderate temperature; and d) curing said liquid bed.

12. A method for the manufacture of paint brushes with a bristle carrier and a bristle facing of individual, vertical plastic bristles, the method comprising the steps of:

a) introducing each individual paint brush bristle at fastening sided ends thereof through respective holes of a template, said holes having a hole diameter slightly larger than a paint brush bristle diameters said template having a hole pattern corresponding to positioning of the paint brush bristles within the bristle facing, the paint brush bristles projecting, in spaced apart relationship corresponding to a hole pattern of said template, through and past an exit side of said template by a substantially same amount;

b) fixing each individual paint brush bristle with respect to axial and radial displacement within said template;

c) submerging, following step b), each individual paint brush bristle projecting past said exit side of said template into a bed of liquid curable material to immerse said fastening sided ends of said paint brush bristles in said liquid bed such that said liquid flows around ends of the paint brush bristles; and d) curing said liquid bed.

13. A method for the manufacture of paint brushes with a bristle carrier and a bristle facing of individual, vertical plastic bristles, the method comprising the steps of:

a) introducing each individual paint brush bristle at fastening sided ends thereof through respective holes of a template, said holes having a hole diameter slightly larger than a paint brush bristle diameter, said template having a hole pattern corresponding to positioning of the paint brush bristles within the bristle facing, the paint brush bristles projecting, in spaced apart relationship corresponding to a hole pattern of said template, through and past an exit side of said template by a substantially same amount;

b) fixing each individual paint brush bristle with respect to axial and radial displacement within said template;

c) submerging, following step b), each individual paint brush bristle projecting past said exit side of said template into a bed of liquid curable material to immerse said fastening sided ends of said paint brush bristles in said liquid bed such that said liquid flows around ends of the paint brush bristles, said liquid curable material comprising one of a liquid adhesive, a plastic polymerizing cold, and a plastic polymerizing at a moderate temperature; and d) curing said liquid bed.

* * * * *